US005490033A

United States Patent [19]

Cronin

[11] Patent Number: 5,490,033

[45] Date of Patent: Feb. 6, 1996

[54] ELECTROSTATIC DISCHARGE PROTECTION DEVICE

[75] Inventor: David V. Cronin, Peabody, Mass.

[73] Assignee: Polaroid Corporation, Cambridge, Mass.

[21] Appl. No.: 234,917

[22] Filed: Apr. 28, 1994

[51] Int. Cl.[6] ..... H05F 3/00

[52] U.S. Cl. ..... 361/212; 439/510; 361/220

[58] Field of Search ..... 361/212, 220; 439/181, 188, 189, 507, 510–515

[56] References Cited

U.S. PATENT DOCUMENTS

| | | | |
|---|---|---|---|
| 3,467,940 | 9/1969 | Wallo . | |
| 3,653,498 | 4/1972 | Kisor . | |
| 3,774,075 | 11/1973 | Medesha | 361/220 |
| 4,019,094 | 4/1977 | Dinger et al. | 361/220 |
| 4,617,605 | 10/1986 | Obrecht et al. | 361/220 |
| 4,822,304 | 4/1989 | Herron | 439/610 |
| 4,824,377 | 4/1989 | De Burro | 439/186 |
| 4,971,568 | 11/1990 | Cronin | 439/188 |
| 5,018,989 | 5/1991 | Black et al. | 439/620 |
| 5,108,299 | 4/1992 | Cronin | 439/188 |
| 5,163,850 | 11/1992 | Cronin | 439/507 |
| 5,164,880 | 11/1992 | Cronin | 361/220 |
| 5,259,777 | 11/1993 | Schuder et al. | 439/188 |
| 5,289,336 | 2/1994 | Gagliano | 361/220 |
| 5,342,220 | 8/1994 | Kodama | 439/607 |
| 5,372,515 | 12/1994 | Miller et al. | 439/138 |

FOREIGN PATENT DOCUMENTS

| | | |
|---|---|---|
| 0432368 | 6/1991 | European Pat. Off. . |
| 2348630 | 3/1975 | Germany . |
| 0071031 | 9/1983 | Germany . |
| 3507875 | 9/1986 | Germany . |
| 3623993 | 1/1988 | Germany . |
| 59-13353 | 1/1984 | Japan . |
| 61-148852 | 11/1986 | Japan . |
| 62-276855 | 1/1987 | Japan . |
| 2025711 | 1/1980 | United Kingdom . |

OTHER PUBLICATIONS

Middlebrook, Carlton G., "Electrical Shorting Cap," *Navy Technical Disclosure Bulletin,* vol. 6, No. 3, Mar. 1981, pp. 33–36 (Navy Technology Catalog No. 5260 1530, Navy Case No. 63818).

Wang, Shay–Ping T., and Ogden, Paul, "Membrane–Type Pin Protector for Pin Grid Array Devices," 1991 IEEE/SEMI Advanced Semiconductor Manufacturing Conference, pp. 120–127.

*Primary Examiner*—Jeffrey A. Gaffin
*Attorney, Agent, or Firm*—Christopher P. Ricci

[57] ABSTRACT

An electrostatic discharge protection device that fits within a connector for high frequency cables having a tubular ground conductor surrounding one or more core conductors. The electrostatic discharge protection device creates a shunt across the one or more core conductors and the ground conductor thus electrically grounding any electrostatic discharge on the one or more core conductors. Upon joining of a complimentary receptor to the connector, the electrostatic discharge protection device automatically withdraws the shunt reestablishing electrical isolation among the one or more core conductors and the ground conductor.

21 Claims, 8 Drawing Sheets

ELECTROSTATIC DISCHARGE PROTECTION DEVICE

BACKGROUND OF THE INVENTION

The present invention relates generally to electrostatic discharge protection devices. More particularly, the invention relates to electrostatic discharge protection devices for connector-receptor assemblies where the electrostatic discharge protection device connects ground and core conductors to inhibit electrostatic charge accumulation when the connector-receptor are disconnected, and automatically disconnects this ground connection upon operative combination of the connector-receptor.

Electrostatic charge is a stationary electric charge which accumulates on various surfaces. An electrostatic discharge occurs when the electrostatic charge becomes substantial enough to overcome a dielectric material between the charge and another surface of a lower electrical potential. An example of such a discharge is naturally occurring lightning.

Electrostatic discharge in the realm of electronics can be devastating to microelectronic devices. A sharp voltage spike caused by an electrostatic discharge can cause permanent and costly damage to individual precision devices, such as random access memory (RAM) or other semiconductor devices, inter alia. Circuit designs which are specially susceptible to electrostatic discharge are those having external connections.

For example, a thicknet local area network (LAN) card in a personal computer is often designed with a BNC type connector extending to the exterior of the personal computer. A coaxial cable having a complimentary BNC connector is attached to the BNC connector on the card to provide access to a network. While the coaxial cable is unattached, electrostatic discharge can occur destroying the devices or components on the card without any physical manifestation leading to costly hardware diagnostics and subsequent repairs.

One solution to this problem has been to place a fixed shunting device on the connector until it is ready for use. The fixed shunting device would create a short circuit between the conductors in the connector, one of which is generally grounded, ensuring that electrostatic charge does not reach the internal electronics. A problem with this device is that it must be removed before the connector is mated with a receptor, id est, a complementary connector. Upon withdrawing the connector, the shunting device is often unavailable for re-insertion into the connector which again opens the electronic devices to possible damage.

A prior art electrical connector-receptor arrangement that provides for an automatic shorting of conductors upon disconnection and opening upon connection which does not require specifically configured receptacle surfaces is disclosed in U.S. Pat. No. 3,467,940 entitled "Electrical Connecting Spring Device", by W. H. Wallo, issued Sep. 16, 1969. This patent shows a coiled compression spring mounted in a separable plug and jack connector assembly wherein the spring automatically expands and grounds the plug in the absence of the jack. The spring is automatically compressed upon insertion of the jack into the plug and compressed so as to electrically disconnect from the plug. However, the coiled compression spring is shown as operating on only a single pin or elongated electrical conductor and would be difficult to adapt to a connector having multiple pins. Additionally, many connectors for high frequency cable contain an dielectric material cylinder that protrudes at least the length of the pin. For such connectors, the coiled compression spring would not be able to contact both the pin and the exterior conductor when uncompressed.

Another prior art electrical connector-receptacle arrangement is described in commonly assigned U.S. Pat. No. 4,971,568 entitled "Electrical Connector Attachment for Automatically Shorting Select Conductors Upon Disconnection of Connector" by David V. Cronin issued Nov. 20, 1990. This patent shows a shunt attachment placed on pins of the connector arranged to provide a short circuit across selected pins. Upon insertion into the receptor, the attachment is compressed causing the short circuit to be broken. While this arrangement is an improvement and is useful for connectors having multiple pins, it is planar and, therefore, can not connect conductors separated by an insulating layer of the type commonly employed in coaxial cable connectors. Other commonly assigned patents relating to electrostatic discharge protection include U.S. Pat. No. 5,163,850 entitled "Electrostatic Discharge Protection Devices for Semiconductor Chip Packages," by David V. Cronin, issued Nov. 17, 1992; U.S. Pat. No. 5,164,880 entitled "Electrostatic Discharge Protection Device for a Printed Circuit Board," by David V. Cronin, issued Nov. 17, 1992; and U.S. Pat. No. 5,108,299 entitled "Electrostatic Discharge Devices for Semiconductor Chip Packages," by David V. Cronin, issued Apr. 28, 1992.

Accordingly, it is an object of this invention to provide an electrostatic discharge protection device operates to automatically open a short between selected conductors upon connection to a mating connector.

It is another object of this invention to provide an electrostatic discharge protection device for use with connectors having a plurality of elongate conductors.

It is still another object of the invention to provide an electrostatic discharge protection device which is operable with non-planar conductor arrangements such as those containing dielectric material shields around conductors.

These and other objects of the invention will be obvious and will appear hereinafter.

SUMMARY

The aforementioned and other objects are achieved by the invention which provides, in one aspect, an electrostatic discharge protection device. The electrostatic discharge protection device is useful with a connector having first and second complimentary members which are adapted to be joined electrically connecting corresponding parts of multiple high frequency cables.

High frequency cables generally have a ground conductor formed in a tubular arrangement to encompass one or more core conductors. The ground conductor is adapted to be electrically grounded and is spaced apart from the core conductors by a dielectric material medium for providing electrical insulation between the core conductors and the ground conductor. Each of two complimentary members of the connector have a ground shell which is electrically connected to the ground conductor and have at least one or more core connector where each core connector electrically connected to a corresponding one of one or more core conductors.

The electrostatic discharge protection device comprises grounding means which is disposed within the ground shell of the first complimentary member. When the first complimentary member is detached from the second complimentary member, the grounding means in the first complimentary member is in an operative position establishing a shunt between the ground shell and each of the one or more core connectors. This shunt places the ground shell and such core connectors of the first complimentary member at a substantially equivalent electrical potential to prevent electrostatic discharge therebetween. Upon joining the first and second complimentary members, the grounding means automatically is displaced into an inoperative position where the shunt is disconnected, allowing the ground shell and such one or more core conductors of the first complimentary member to become substantially electrically isolated.

The electrostatic discharge protection device can be used with a male-type or female-type connector and is reusable in that the first complimentary member and the second complimentary member can be joined and disconnected multiple times without detriment to the operation of the grounding member.

In further aspects, the invention provides methods in accord with the apparatus described above. The aforementioned and other aspects of the invention are evident in the drawings and in the description that follows.

BRIEF DESCRIPTION OF THE DRAWINGS

The foregoing and other objects of this invention, the various features thereof, as well as the invention itself, may be more fully understood from the following description, when read together with the accompanying drawings in which.

DETAILED DESCRIPTION

The invention is used with connector-receptor pairs for high frequency cable. High frequency cable is generally designed with one outside conductor surrounding one or more core conductors. The outside conductor is generally grounded such that it remains electrically neutral. In this way, the enclosed core conductors are shielded from electromagnetic signals and noise. Connecting two or more of these high frequency cables requires connectors adapted for such a conductor arrangement. Examples of such connectors are known in the art as a subminiature connector (hereinafter "SMA") and a bayonet navy connector (hereinafter "BNC") connector, both of which are illustrated herein.

While the present invention retains utility within a wide variety of electrical connectors and may be embodied in several different forms, it is advantageously employed in connection with the above-mentioned connectors. Though these are the forms of the illustrated embodiments and will be described as such, these embodiments should be considered illustrative and not restrictive.

Figure 1:
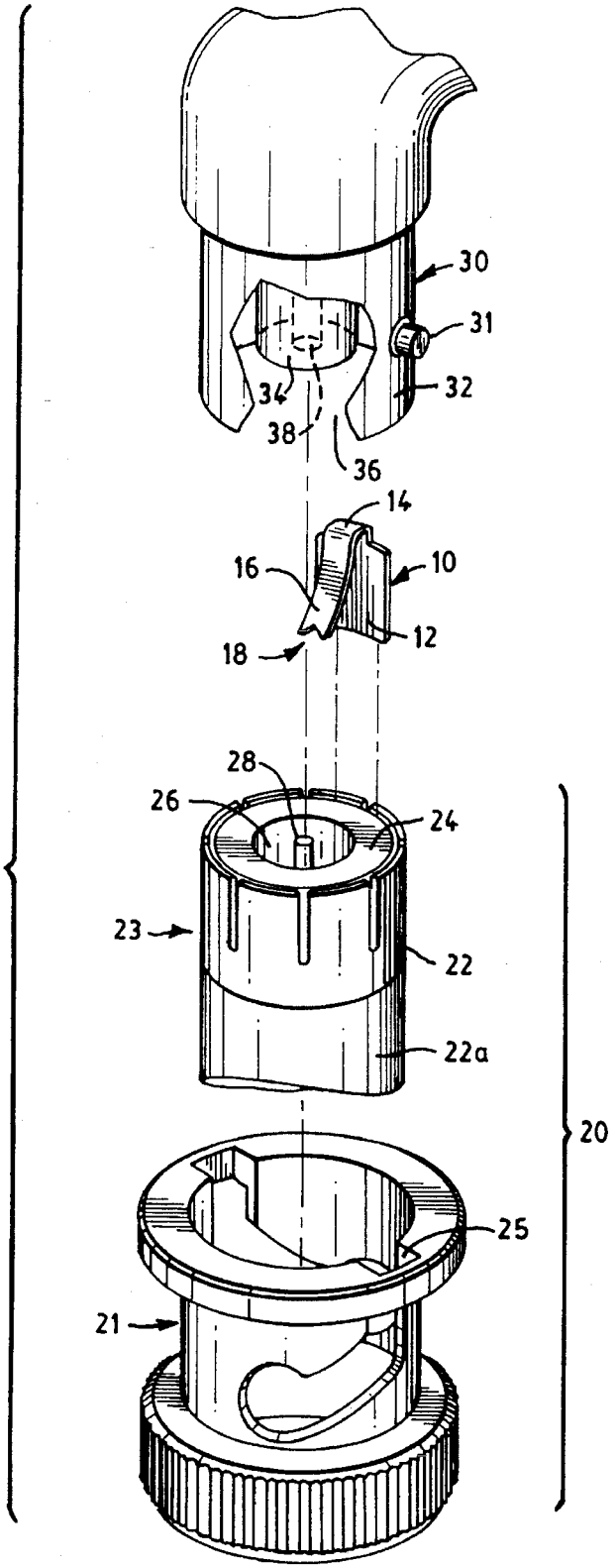
FIG. 1 shows an exploded perspective view of a BNC-type electrical connector-receptor and an electrostatic discharge protection device in accordance with the invention.
Figure 2:
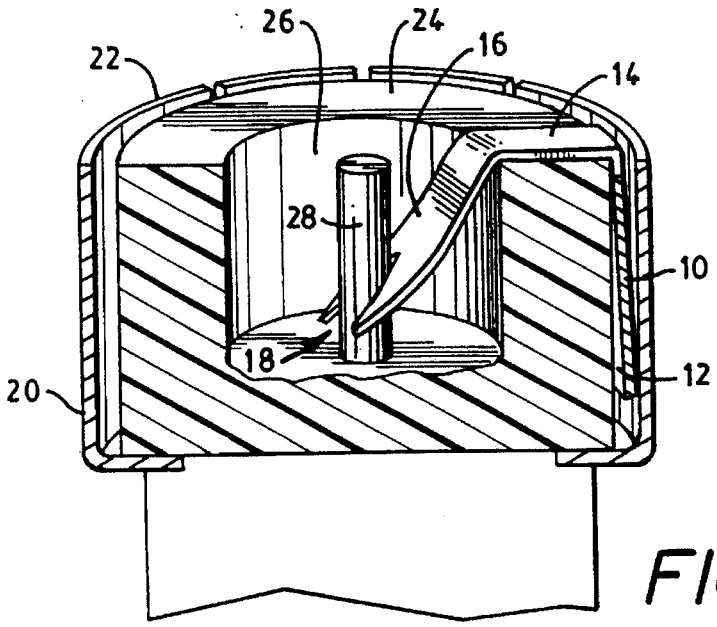
FIG. 2 shows perspective view of a BNC-type connector utilizing the electrostatic discharge protection device of FIG. 1.
Figure 3:
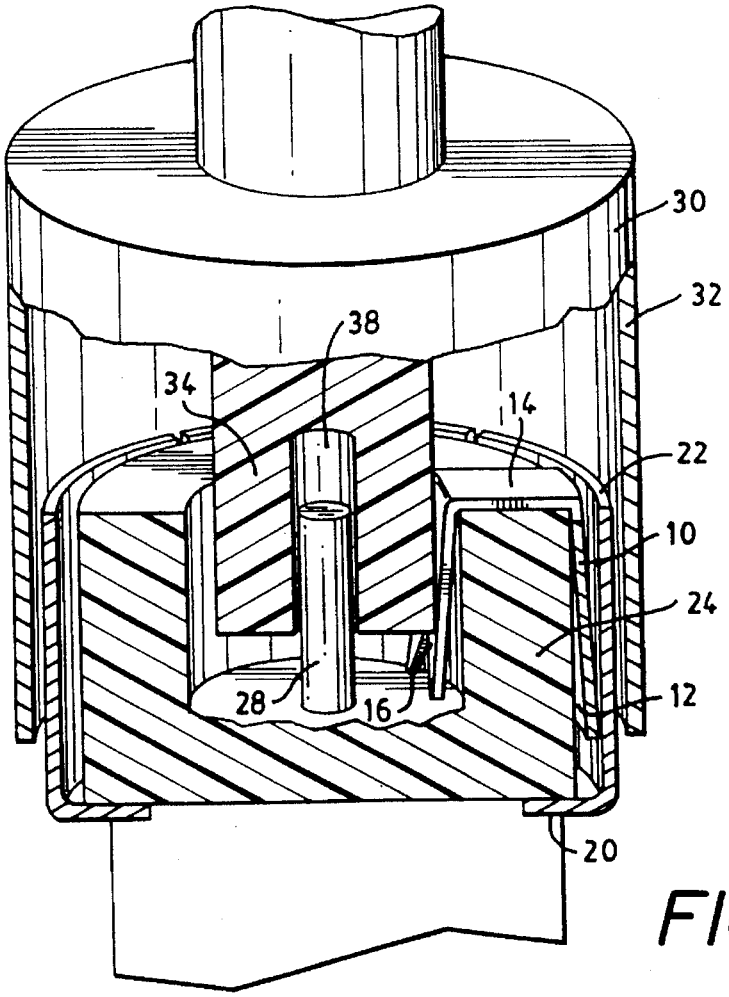
FIG. 3 shows perspective view of a BNC-type connector utilizing the electrostatic discharge protection device of FIG. 4 in full engagement with a receptor.

Referring now to FIGS. 1–3, there is shown generally the electrical connector and receptor assembly of the invention comprising a connector 20, a receptor 30 and a electrostatic discharge protection device 10. The connector 20 in one embodiment is a BNC connector having a cylindrical housing 21 for securing the receptor 30 upon insertion. Enclosed within the cylindrical housing 21 is a cable terminator 23 which is electrically connected to a high frequency cable. In the following discussion, the high frequency cable is a coaxial cable consisting of a conducting outer metal tube enclosing and insulated from a central conducting core. Though this is the exemplified form, other high frequency shielded cables may be substituted without detriment to the invention and therefore the use of coaxial cable should be considered illustrative and not restrictive.

The cable terminator 23 is arranged for a coaxial cable as previously discussed. A ground conductor or shell 22 is in electrical communication with the outer metal tube **22*a* of the coaxial cable and is arranged in the connector 20 in a manner similar to that of the outer metal tube in a coaxial cable. The outer metal tube 22*a* of a coaxial cable is generally held electrically neutral, or ground, which provides a shield for inner conductors. Outside electromagnetic interference strikes the outside metal tube and is grounded thus stopping penetration into the cable. As such, the ground conductor 22**, being in electrical communication with the outside metal tube, is also electrically neutral.

A dielectric material ring 24 is enclosed by the ground conductor. The dielectric material ring 24 is an electrical insulator ensuring that conduction between the ground conductor 22 and central conductor is inhibited.

An open bore 26 is enclosed by the dielectric material ring 24 for receiving the receptor as further described herein.

Extending axially through the center of the bore 26 is a core connector 28. The core connector 28 is a hollow pin which receives and is electrically connected to the central conducting core of the coaxial cable which ultimately connects to other electrical components remotely stationed with respect to the connector 20 in a well known manner.

The connector 20 is adapted for ready insertion or withdrawal from the complimentary receptor 30 which is also a termination point for a coaxial cable. The receptor 30 mates with the connector 20 in such a way as to allow electrical communication between the coaxial cables. In the BNC connector, this is accomplished by inserting two pegs 31 extending radially outward from the receptor following a diameter of the cable into a slot 25 in the cylindrical housing 21. The receptor 30 is pushed down into the connector 20 such that the pegs 31 follow the slot 25 into a locked position. Withdrawal is accomplished following a similar process, but reversed.

When the receptor 30 is inserted into the connector 20, a ground shell 32 passes between the cylindrical housing 21 and the ground conductor 22. The ground shell 32 may or may not make mechanical contact with the ground conductor 22, but in either event, conduction is allowed through the cylindrical housing 21 which is in electrical communication with the ground conductor 22.

As with the connector 20, the receptor 30 uses a dielectric material to separate the conductors. In the case of the receptor 30, a dielectric material ring 34 is formed with an outside diameter slightly less than the diameter of the bore 26 of the connector such that upon insertion the dielectric material ring 34 fits within the bore 26.

Enclosed by the dielectric material ring 34 is a ferrule or complimentary connector 38 which is in electrical communication with the central conducting core of the coaxial cable attached to the receptor 30. The ferule has an inside diameter which is which is substantially the same as the outside diameter of the core connector 28. As the core connector 28 is inserted into the ferrule 38, the ferrule expands due to radial pressure caused by the mechanical contact with the core conductor 28. This mechanical contact establishes electrical continuity within the coaxial cables thus electrically connecting same.

The electrostatic discharge protection device 10 of the invention is a conductive device in the form of a grounding member or means that operates with the above-described connector-receptor relationship to ground electrostatic charge from the central conducting core of the coaxial cable gathered while in an unconnected state. The electrostatic discharge protection device 10 accomplishes this by creating a shunt between the outer metal tube 22 and the central core connector 28 thus making the central conducting core electrically neutral and stopping propagation of electrostatic charge or noise to any attached electronic components.

This is accomplished in one embodiment by electrostatic discharge protection device 10. The electrostatic discharge protection device 10 is fabricated to be electrically conductive while having a high spring constant providing resiliency. In the preferred embodiment, a spring alloy of beryllium copper is used.

It should be noted that the addition of any conductive device into a connector for a high frequency cable increases susceptance. This becomes a problem at extremely high frequencies in the gigahertz range at which point losses due to conductance to ground affect the connector. For the times when this becomes an issue, the electrostatic discharge protection device 10 may be fabricated of conductive plastic or other material having a higher impedance, or a contact on the electrostatic discharge protection device can be coated with a resistive material to increase overall impedance. Since a characteristic of electrostatic discharge is high voltage with low current, a higher impedance has minimal effect upon the protective capabilities of the electrostatic discharge protection device.

The electrostatic discharge protection device 10 for the connector 20 comprises three basic parts: a ground tab 12, a bridge 14, and a contact 16. In the preferred embodiment, the ground tab 12 is planar and has a width which was experimentally determined to be optimum at approximately ⅛ inch. The experimentation weighed the fact that as the width increased susceptibility increased proportionally and as susceptance increases the usable frequency range for the connector decreases; but if the width was too small then the force holding the electrostatic discharge protection device in position would not be enough and the electrostatic discharge protection device would cock upon combination of the connector and receptor and fall out upon withdrawal. Therefore, the width of the ground tab 12 should be minimized while still retaining its ability to hold the electrostatic discharge protection device in position.

The ground tab 12 is placed between the ground conductor 22 and the dielectric material ring 24. Because the ground tab 12 is planar and is placed between two concentric annular bodies, the ground tab is forced to curve along the outer radius of the dielectric material ring 24. The ground tab 12 in attempting to retain its planar structure due to its resilient spring bias, extends outward against the inner radius of the ground conductor 22. This arrangement creates a strong frictional resistance against removing the electrostatic discharge protection device 10 from this position and ensures good electrical contact with the ground conductor 22.

Other embodiments are held in placed by placing a curve in the ground tab 12 that has a radius substantially less than the radius of the dielectric material ring 24 and the ground conductor 22. Upon insertion, the spring bias forces the ground tab 12 against the lateral surface of the ground conductor 22 holding the electrostatic discharge protection device in position. One skilled in the art knows that other alternatives, such as using a conductive adhesive or bending the corners of the ground tab 12, may also be used to retain the electrostatic discharge protection device 10 in connector 20.

The bridge 14 extends from the ground tab 12 radially inward toward the center of the connector 20. The length of the bridge 14 is substantially the same as that of the dielectric material ring 24 thus carrying the electrostatic discharge protection device over the dielectric material into the bore 26.

The contact 16 extends from tile bridge 14 downward at an angle with respect to the ground tab 12 pressing the contact 16 against the core conductor 28. The transition between the bridge 14 and the contact 16 is curved such that repeated combinations of the receptor-connector do not cause the bend to kink and break. A similar gradual bend is placed in the contact 16 making the bend tangent to a lateral surface of the dielectric material ring 24 and then proceeding along a circular radius, further avoiding the problem of kinking.

When fabricated, the contact 16 has an angle with respect to the ground tab 12 in excess of the angle maintained when the electrostatic discharge protection device 10 is inserted into the connector 20. In this way, the resilient spring bias of the electrostatic discharge protection device 10 urges the contact 16 against the core conductor 28 thus establishing electrical communication between the core conductor 28 and the ground conductor 22.

The contact 16 has a notch 18 at its distal end in the shape of a "V". The "V" ensures that the contact 16 will always engage the core conductor 28 in the desired position: the center of the "V". At the same time, the "V" increases surface area contact to ensure proper conduction.

Grounding the core conductor 28 is desirable when the connector-receptor are detached, but when connected, grounding the core connector undermines the usefulness of the cable. Therefore, the electrostatic discharge protection device 10 of the invention automatically breaks the shunt between the core conductor 28 and the ground conductor 22 upon combination with the receptor 30. Looking more specifically at FIG. 3, the invention accomplishes this by allowing the dielectric material ring 24 to displace or push the contact 16 away from the core conductor 28 such that is immured between the dielectric material ring 24 of the connector 20 and the dielectric material ring 34 of the receptor.

Upon withdrawal of the receptor 30, the spring bias of the contact 16 immediately forces the contact 16 back into electrical communication with the core conductor 28 again grounding the core conductor 28.

Figure 4:
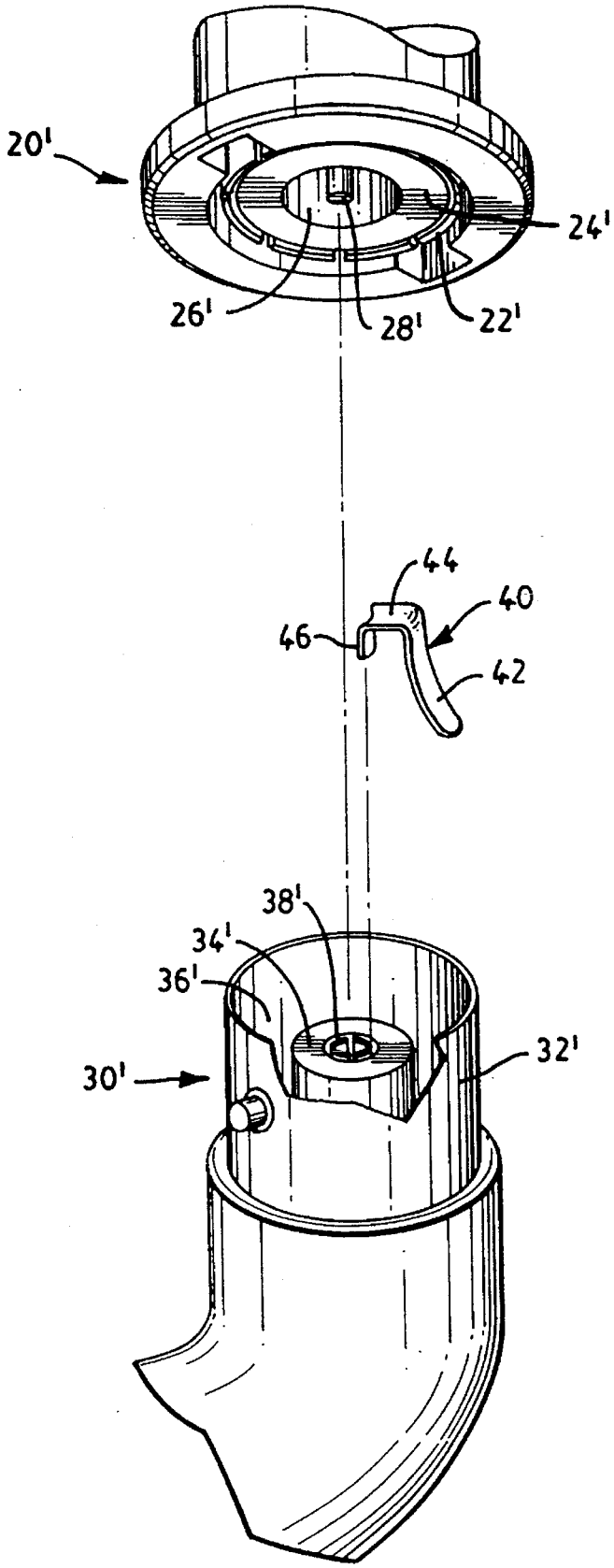
FIG. 4 shows an exploded perspective view of a BNC-type electrical connector-receptor and an electrostatic discharge protection device in accordance with the invention.
Figure 5:
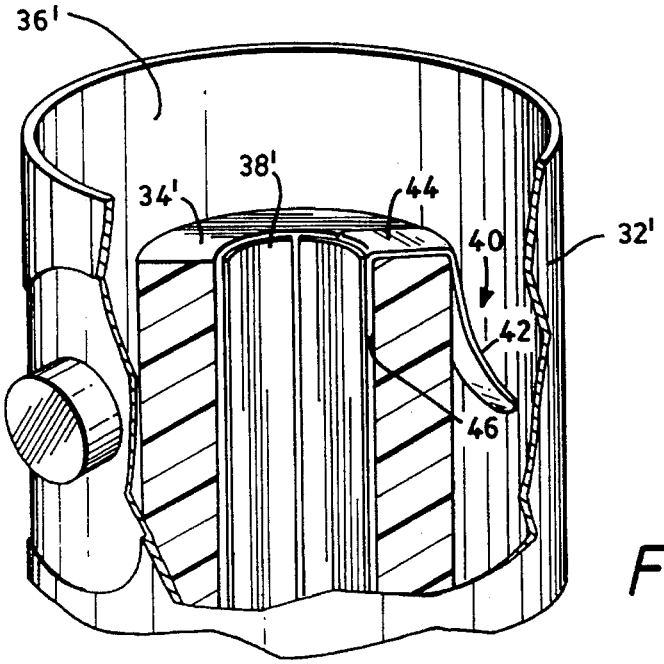
FIG. 5 shows perspective view of a BNC-type receptor utilizing the electrostatic discharge protection device of FIG. 4.
Figure 6:
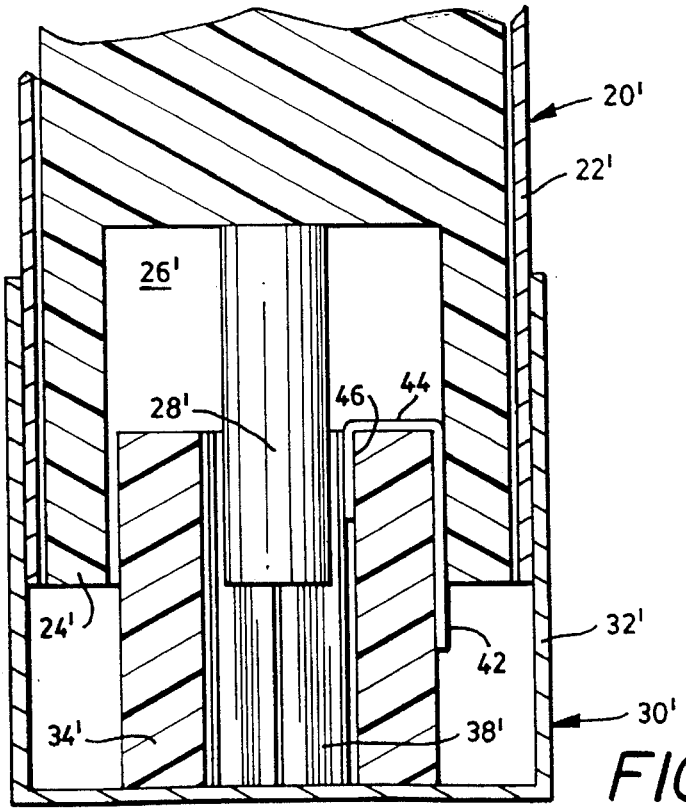
FIG. 6 shows cross-sectional view of a BNC-type connector in full engagement with a receptor utilizing the electrostatic discharge protection device of FIG. 4.

Referring now to FIGS. 4–6 where like numerals designate previously described elements, there is shown an alternate embodiment of the invention. In contrast to the previous embodiment, the electrostatic discharge protection device 40 is inserted into the receptor 30'. Having made this distinction, it should be noted that these embodiments are not mutually exclusive for use in one connector-receptor assembly. An electrostatic discharge protection device may be on both the receptor and on the connector without detriment as long as there exists an angular separation distance of approximately 45° to avoid an impedance drop between the two conductive devices.

In this embodiment, the electrostatic discharge protection device 40 or grounding means is placed over the dielectric material ring 34' as before such that a bridge 44 spans the dielectric material ring 34'. Extending down from the bridge and radially outward is a ground contact 42. As with the contact 16 of the connector 20 arrangement, the ground contact 42 is formed such that placement of the ground contact 42 within the bore 36' forces the ground contact inward from its fabricated position. This creates an outward spring bias causing the ground contact to engage the ground shell 32'.

The distal end of the ground contact 42 is slightly rounded such that upon disengagement of the connector-receptor, the ground contact 42 will not bind the connector by biting into the dielectric material ring 24'.

Extending down from the bridge toward the center of the receptor 30' is a ferrule contact 46. Analogous to the ground tab 12 of the connector arrangement, the ferrule contact 46 is planar and is forced in between two concentric annular rings: the ferrule 38' and the dielectric material ring 34'. The spring bias pushes the ferrule contact 46 toward a planar geometry creating a force that holds the electrostatic discharge protection device 40 in place as well as establishing an electrical contact against the ferrule 38'.

Upon insertion into the connector 20', the dielectric material ring 24' of the connector pushes the ground contact 42 down away from the ground shell 32' breaking the short circuit previously established.

The electrostatic discharge protection device 40 remains in this disengaged position until the receptor 30' is removed from the connector 20' at which time the spring bias of the ground contact 42 causes the short circuit to be reestablished.

The previous embodiments are well adapted for use with connectors having a central core contact which extends axially from within the connectors. For connectors that do not have such an arrangement, such as an SMA connector, a different configuration of the electrostatic discharge protection device must be used. The SMA connector is oriented similarly to the BNC connector with a primary difference being that the central conductor and dielectric material ring do not extend axially from the bottom of the connector.

Figure 7:
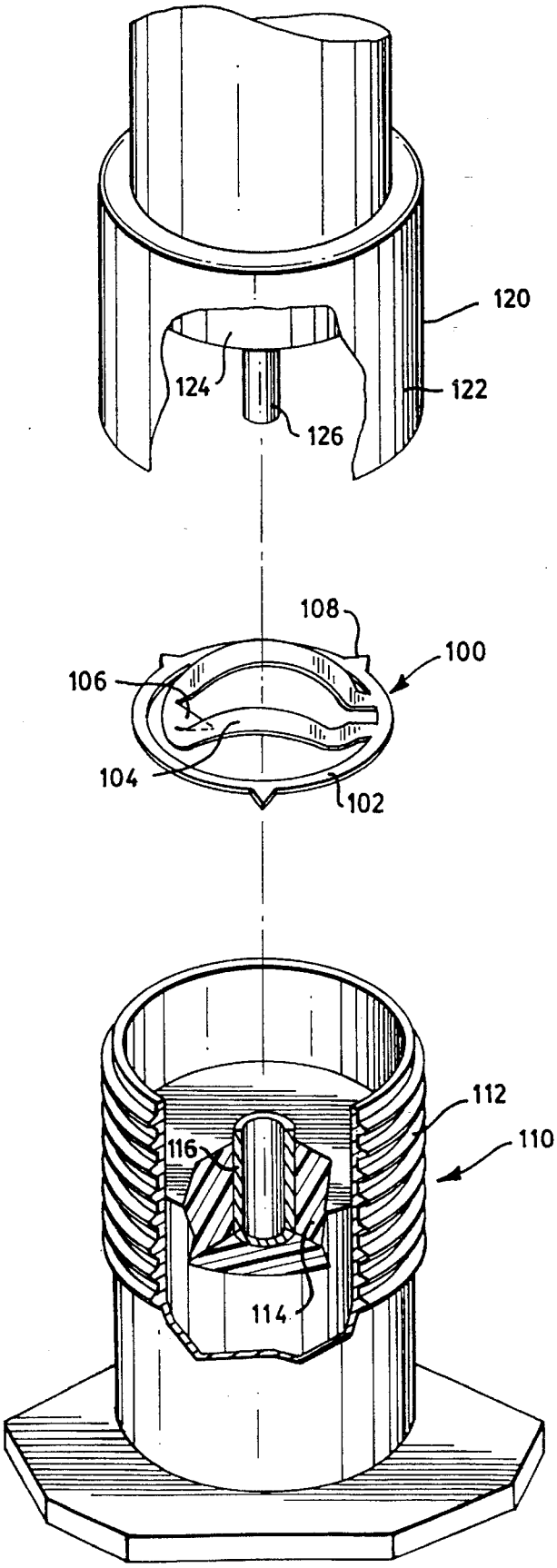
FIG. 7 shows an exploded perspective view of a SMA-type electrical connector-receptor and an electrostatic discharge protection device in accordance with the invention.
Figure 8:
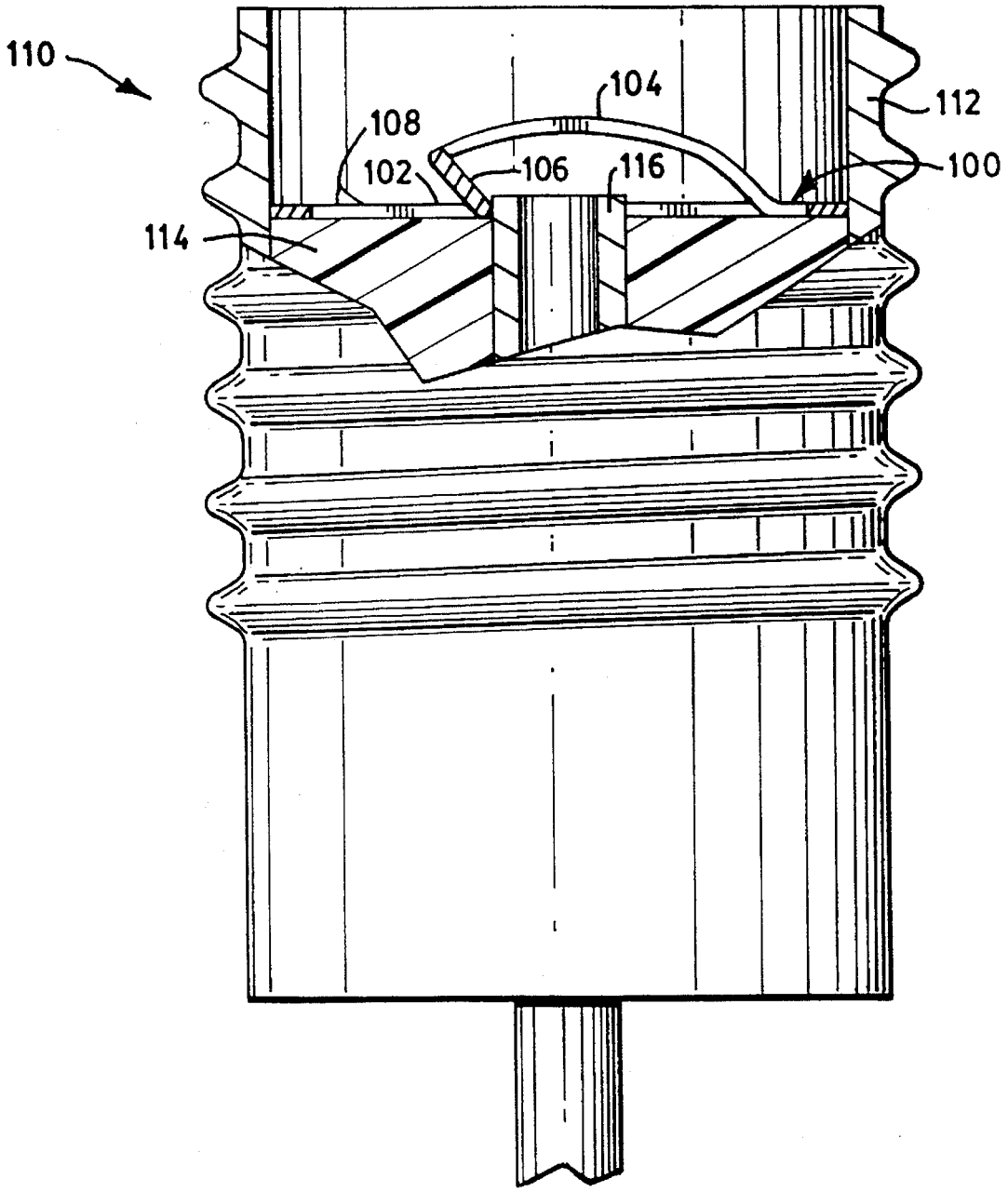
FIG. 8 shows perspective view of a SMA-type receptor utilizing the electrostatic discharge protection device of FIG. 7.
Figure 9:
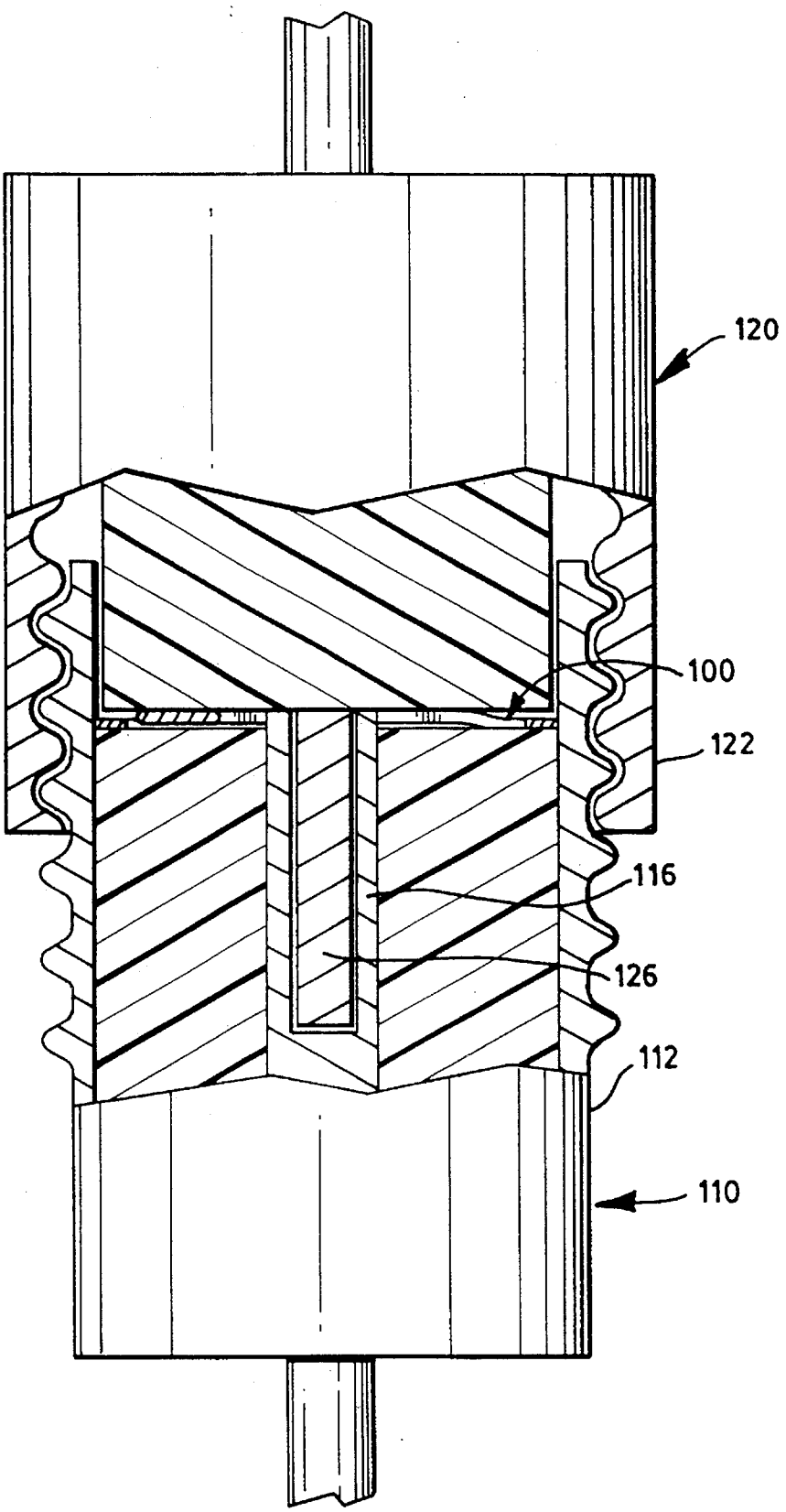
FIG. 9 shows perspective view of a SMA-type connector in full engagement with a receptor utilizing the electrostatic discharge protection device of FIG. 7.

Referring now to FIG. 7–9, there is shown an alternate embodiment of the invention. In contrast to the previous embodiments, the electrostatic discharge protection device 40 is adapted for a ferrule which does not project from the base of the connector. The depicted receptor 110 of an SMA connector illustrates such an arrangement.

A ground shell 112 forms the outer housing of the receptor and is connected to the outer metal tube of the coaxial cable. In the case of an SMA connector, the ground shell is threaded on its exterior surface to allow a locking connection with a connector 120.

Housed within the ground shell 112 is a dielectric material 114 surrounding a ferrule 116. The arrangement is similar to the previously described BNC connector except that the dielectric material 114 extends radially out to the ground shell 112. The ferrule 116 at a proximal point is flush with a surface 118 of the dielectric material.

In this embodiment, a electrostatic discharge protection device 100 is arranged to contact only the top of the ferrule 116 and to conduct between the ground shell 112 and the ferrule 116 in this way.

The electrostatic discharge protection device 100 is formed to be substantially planar such that a ground plate 102 can be placed flatly over the surface 118 of the dielectric material 114. When placed in this way, extensions from the ground plate 102, called darts 108, are bent slightly upward away from the surface 118 and in contact with the ground shell 112. The darts 108 hold the electrostatic discharge protection device 100 firmly in place by biting into the lateral surface of the ground shell 112 and at the same time establish an electrical connection with the ground shell 112.

The ground plate 102 is a flat annular ring having two flanks 104 that extend toward the enclosed region of the ring. The flanks 104 are formed having a semicircular bend extending outward from the plane of the ground plate 102 away from the surface 118 of the dielectric material 114. The flanks 104 are formed of a resilient conductive material, such as beryllium copper, such that the may be repeatedly compressed flat and upon removal of the compression force, the flanks regain their former shape. The two flanks 104 meet at a distal point near a geometric center of the ground plate 102 to form an aperture 107 which is bounded by the flanks 104 and the ground plate 102.

Projecting into the aperture 107 from the flanks 104 is a barb 106. The barb 106 is bent at an angle axially with respect to the central axis of the electrostatic discharge protection device but projects toward the surface 118 of the dielectric material. The barb 106 is fabricated of the same or similar resilient conductive material as the flanks and provides a contact with the ferrule 116.

When the electrostatic discharge protection device 100 is pushed down into the ground shell 112, the darts 108 bend slightly biting into the lateral surface of the ground shell to both hold the electrostatic discharge protection device 100 into place as well as create an electrical contact with the ground shell 112. The electrostatic discharge protection device 100 being in an uncompressed form, places the barb 106 slightly inside the ferrule 116 such that a surface of the barb 106 is resting against the top of the ferrule 116. In this way, electrical communication is established between the ferrule 116 and the ground shell 112 thus grounding any electrostatic discharge in the ferrule.

The connector 120 is then used to mate with the receptor 110 to combine two or more coaxial cables. The connector 120 has a housing 122 which has interior threads and is in electrical communication with outer metal tube of the coaxial cable. The housing 122 is threaded in such a way as to be complimentary to the threads of the ground shell 112, thus allowing threaded combination of the connector 120 and the receptor 110.

The connector 120 has a core conductor 126 which projects out axially from the center of the connector 120 and out beyond a dielectric material 124 which separates the core conductor 126 and the housing.

When the connector 120 is inserted into the receptor 110 and the housing 122 is rotated such that tile connector is fully inserted, see FIG. 9, compression between the dielectric material 124 and the dielectric material 114 forces the flanks 104 and the barb 106 to flatten. By flattening, the flanks 104 push the barb 106 away from the ferrule 116 and toward the ground shell 112 breaking electrical communication and opening the short circuit which had been established.

Upon removal of tile connector 120 from the receptor 110 to disconnect the coaxial cable, the electrostatic discharge protection device 100 resumes its normal form thus reestablishing a short circuit across the ferrule 116 and the ground shell 112.

Figure 10:
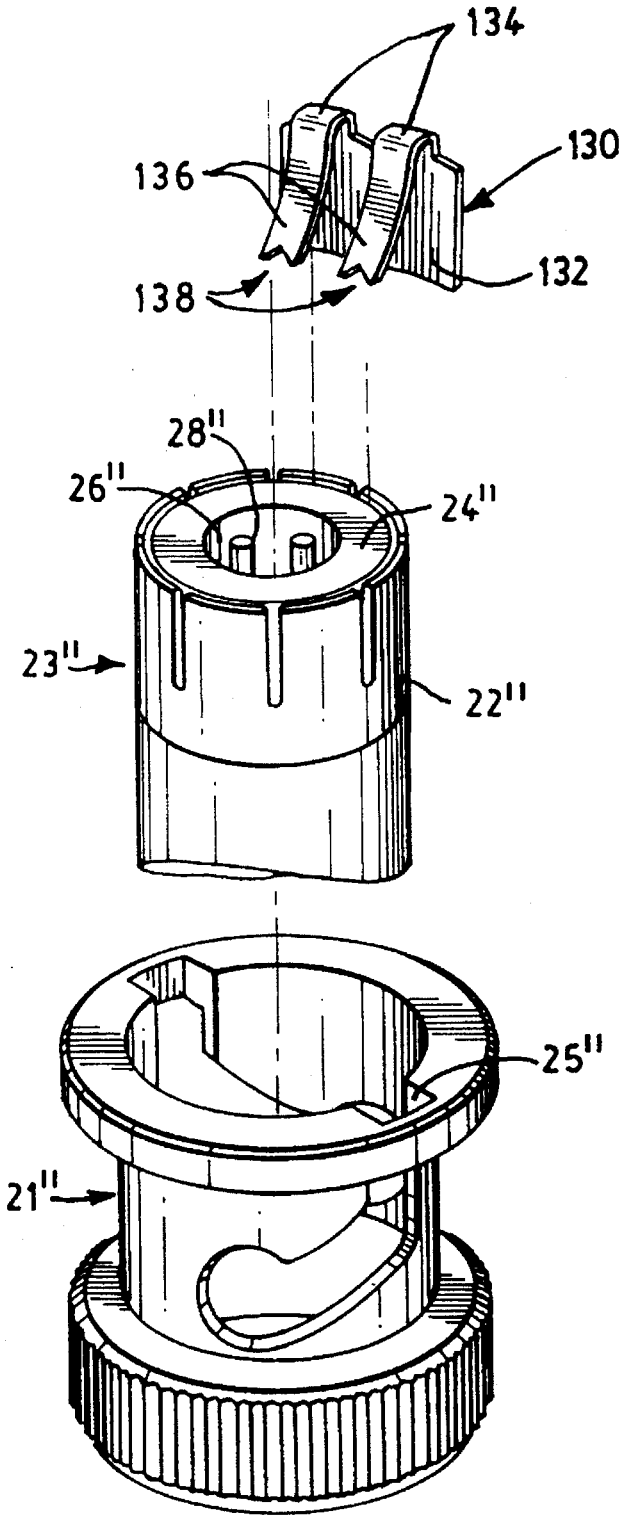
FIG. 10 shows a perspective view of a BNC-type connector for a twinaxial cable with an electrostatic discharge protection device in accordance with the invention.

Referring to FIGS. 10 where like numerals designate previously described elements, there is shown an alternate embodiment of the invention. In contrast to the previous embodiment, the electrostatic discharge protection device 130 is designed for use with a twinaxial cable which a high frequency cable having two core conductors. Though the invention may be used with cable arrangements having multiple core conductors in excess of the two described herein, one skilled in the art will realize that such an adaptation is simply an extension of this teaching. The connector is shown having two corresponding core connectors 28". Otherwise, the BNC connector is as previously described.

In this embodiment, the electrostatic discharge protection device 130 is placed over the dielectric ring 24" as before such that bridges 134 span the dielectric ring 34". Extending down from the bridges 134 radially inward are contacts 136, each having a notch 138. From an outer point of the bridge 134 extends a ground tab 132 which is structured similarly to the ground tab of the first embodiment described herein. In this embodiment, there are two bridges extending from the ground tab 132. One skilled in the art will realize that other arrangements are possible, such as a single bridge and multiple contacts extending therefrom, without departing from the inventive aspects described herein. Adapting the receptor version of the electrostatic discharge protection device is accomplished in a similar manner and is considered a trivial exercise for one skilled in the art.

The invention may be embodied in other specific .forms without departing from the spirit or essential characteristics thereof. The present embodiments are, therefore, to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. An electrostatic discharge protection device for use with a connector having first and second complimentary members which are adapted to be joined electrically connecting corresponding parts of multiple high frequency cables; each high frequency cable having a ground conductor formed in a tubular arrangement to encompass one or more core conductors where said ground conductor is adapted to be electrically grounded and is spaced apart from said one or more core conductors by a dielectric material for providing electrical insulation between the one or more core conductors and the ground conductor; the first complimentary member having a ground shell which is electrically connected to the ground conductor and having one or more core connectors, where each of the one or more core connectors is electrically connected to a corresponding one of the one or more core conductors of the first complimentary member; the second complimentary member having a ground shell which is electrically connected to the ground conductor and having one or more core connectors, where each of the one or more core connectors is electrically connected to a corresponding one of the one or more core conductors of the second complimentary member, said electrostatic discharge protection device comprising grounding means disposed within the ground shell of the first complimentary member having an operative position for establishing a shunt between the ground shell and each of the one or more core connectors which places the ground shell of the first complimentary member and the one or more core connectors of the first complimentary member at a substantially equivalent electrical potential when the first complimentary member is detached from the second complimentary member, and said grounding means having an inoperative position for interrupting the shunt to allow the ground shell and the one or more core conductors of the first complimentary member to become substantially electrically isolated when the first complimentary member is joined with the second complimentary member.

2. The electrostatic discharge protection device according to claim 1 wherein said first complimentary member is a male connector and said second complimentary member is a female receptor.

3. The electrostatic discharge protection device according to claim 1 wherein said first complimentary member is a female connector and said second complimentary member is a male receptor.

4. The electrostatic discharge protection device according to claim 1 wherein said grounding member is reusable in that the first complimentary member and the second complimentary member can be joined and disconnected multiple times without substantial detriment to the grounding member.

5. The electrostatic discharge protection device according to claim 1 wherein the grounding member is configured for automatic movement between the operative position and the inoperative position, and vice versa.

6. An electrostatic discharge protection device for use with a connector having first and second complimentary members which are adapted to be joined electrically connecting corresponding parts of multiple high frequency cables; each high frequency cable having a ground conductor formed in a tubular arrangement to encompass one or more core conductors where said ground conductor is adapted to be electrically grounded and is spaced apart from said core conductors by a dielectric material for providing electrical insulation between the core conductors and the ground conductor; the first complimentary member having a ground shell which is electrically connected to the ground conductor and having one or more core connectors, each core connector electrically connected to one core conductor; the second complimentary member having a ground shell which is electrically connected to the ground conductor and having one or more core connectors, each core connector electrically connected to one core conductor, said electrostatic discharge protection device comprising grounding means for providing electrical contact with the ground shell of the first complimentary member; and contact member disposed within the ground shell in electrical communication with said grounding means and having an inherent resilient bias to urge the contact member into an operative position creating an electrical path between said one or more core connectors of the first complimentary member and the ground shell of the first complimentary member such that the one or more core connectors are held electrically ground, said second complimentary member having a structure that overcomes the inherent resilient bias upon joining the first and the second complimentary members of the connector such that the electrical path between the ground shell and the one or more core connectors is interrupted.

7. The electrostatic discharge protection device according to claim 6 further comprising a bridge member electrically conductive between said grounding means and said contact member, said bridge member extending from said grounding means to the contact member traversing the dielectric material.

8. The electrostatic discharge protection device according to claim 7 wherein said connector has a central axis and said contact member and said grounding means are oriented substantially parallel to said central axis while said bridge member is oriented transverse to said central axis.

9. The electrostatic discharge protection device according to claim 8 wherein said contact member and said grounding means extend from an interior portion of the first complimentary member to an exterior portion of the first complimentary member; the bridge member couples the grounding means and the contact member in the exterior portion.

10. The electrostatic discharge protection device according to claim 7 wherein said electrostatic discharge protection device comprises a plurality of bridge members where each of the bridge members are connected to a contact member, and each said bridge means extends from a singular grounding member.

11. The electrostatic discharge protection device according to claim 10 wherein said electrostatic discharge protection device further comprises one or more barbs extending radially outward from said grounding means to secure the electrostatic discharge protection device within the ground shell of the first complimentary member.

12. The electrostatic discharge protection device according to claim 11 wherein said grounding means further comprises barbs projecting radially from said grounding means for mechanically engaging an interior lateral surface of said ground conductor of the first complimentary member to secure the electrostatic discharge device.

13. The electrostatic discharge protection device according to claim 7 wherein said electrostatic discharge protection device is substantially planar and said bridge member is curved laterally outward away from a plane of the electrostatic discharge protection device.

14. The electrostatic discharge protection device according to claim 6 wherein said contact mean is formed having a curve beginning tangent to a lateral surface of the dielectric material and proceeding along a circular radius to inhibit kinking.

15. The electrostatic discharge protection device according to claim 6 wherein said grounding means is rounded to facilitate withdrawal of the first complimentary member from the second complimentary member.

16. The electrostatic discharge protection device according to claim 6 wherein said grounding means comprises a resilient planar tab.

17. The electrostatic discharge protection device according to claim 6 contact member comprises a resilient planar tab.

18. The electrostatic discharge protection device according to claim 6 wherein said contact member has a distal end which electrically communicates with said core connector and said distal end is formed with a "V" shaped cut.

19. The electrostatic discharge protection device according to claim 6 wherein said electrostatic discharge protection device comprises a plurality of contact members, each of the contact members adapted to contact a core connector and each of the contact members extend from a singular grounding means.

20. An electrostatic discharge protection device for use with a cable connector having first and second complimentary members which, when joined, combine multiple high frequency cables; each high frequency cable having a ground conductor formed in a tubular arrangement to encompass at least one core conductor where said ground conductor is electrically neutral and is held apart from said at least one core conductor by a dielectric material such that electrical communication is inhibited between the at least one core conductor and the ground conductor, said electrostatic discharge protection device comprising grounding means having an annular structure about a central axis forming an aperture and in communication with said ground conductor, said grounding means for providing electrical contact with the ground conductor of the first complimentary member;

a bridge member in electrical communication with said grounding means and extending from said grounding means into said aperture such that the bridge member traverses the dielectric material and is formed with a bridge bulge to bias said bridge member axially outward parallel to the central axis; and contact member in electrical communication with said bridge member having a contact angle to urge the contact member axially inward with respect to the central axis into electrical contact engagement with said at least one core conductor for providing a shunt between said at least one core conductor and said ground conductor of the first complimentary member, said contact angle said bridge bulge being displaced upon operative combination of the first and the second complimentary members of the cable connector such that the shunt is opened and the ground conductor and the at least one core conductor become electrically isolated.

21. An electrostatic discharge protection device for selectively connecting a ground conductor in a connector-receptor assembly to one or more core conductors in the connector-receptor assembly where the connector-receptor assembly is adapted to be connected and disconnected to establish or break an electrical path, respectively, the electrostatic discharge protection device comprising a ground member fixedly disposed within the connector-receptor assembly in electrical contact with the ground conductor; and a contact member extending from the ground member having an operative position and an inoperative position, the operative position being attained when connector-receptor assembly is disconnected allowing an inherent resilient bias of the contact member to urge the contact member into electrical contact with the one or more core conductors to establish electrical communication between the one or more core conductors and the ground conductor thus inhibiting electrostatic charge accumulation on the one or more core conductors, the inoperative position being attained upon operative connection of the connector-receptor assembly such that the inherent resilient bias of the contact member is automatically overcome removing the electrical contact with the one or more core conductors thus creating electrical isolation between the one or more core conductors and the ground conductor.

* * * * *